US008287093B2

(12) United States Patent
Hoisington et al.

(10) Patent No.: US 8,287,093 B2
(45) **Date of Patent: *Oct. 16, 2012**

(54) DROP EJECTION ASSEMBLY

(75) Inventors: Paul A. Hoisington, Hanover, NH (US); John A. Higginson, Santa Clara, CA (US); Andreas Bibl, Los Altos, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 58 days.

This patent is subject to a terminal disclaimer.

(21) Appl. No.: 12/510,513

(22) Filed: Jul. 28, 2009

(65) Prior Publication Data

US 2009/0303269 A1 Dec. 10, 2009

Related U.S. Application Data

(62) Division of application No. 11/805,904, filed on May 25, 2007, now Pat. No. 7,578,573, which is a division of application No. 10/749,829, filed on Dec. 30, 2003, now Pat. No. 7,237,875.

(51) Int. Cl.
*B41J 2/14* (2006.01)

(52) U.S. Cl. ..... 347/47

(58) Field of Classification Search ..... 347/45–47, 347/68

See application file for complete search history.

(56) References Cited

U.S. PATENT DOCUMENTS

| | | | | |
|---|---|---|---|---|
| 3,747,120 | A | 7/1973 | Stemme | |
| 4,358,781 | A | 11/1982 | Yamamori et al. | |
| 4,459,601 | A | 7/1984 | Howkins | |
| 4,528,996 | A | 7/1985 | Jones | |
| 4,613,875 | A | 9/1986 | Le et al. | |
| 5,757,391 | A | 5/1998 | Hoisington | |
| 5,912,689 | A | 6/1999 | Otsuka et al. | |
| 6,041,600 | A | 3/2000 | Silverbrook | |
| 6,132,028 | A | 10/2000 | Su et al. | |
| 6,193,356 | B1 | 2/2001 | Takata | |
| 6,235,212 | B1 | 5/2001 | Silverbrook | |
| 6,264,307 | B1 | 7/2001 | Silverbrook | |
| 6,439,695 | B2 | 8/2002 | Silverbrook | |
| 6,536,874 | B1 | 3/2003 | Silverbrook | |
| 6,582,059 | B2 | 6/2003 | Silverbrook | |
| 7,237,875 | B2 * | 7/2007 | Hoisington et al. | 347/68 |

FOREIGN PATENT DOCUMENTS

| | | |
|---|---|---|
| EP | 1 016 532 | 7/2000 |
| EP | 1 052 099 | 11/2000 |
| EP | 1 334 833 | 8/2003 |
| GB | 2 339 170 | 1/2000 |
| JP | S54-10493 | 5/1979 |

(Continued)

OTHER PUBLICATIONS

Supplementary European Search Report under Article 153(7) EPC, dated Jul. 21, 2009, EP Application No. 04817071.6.

(Continued)

*Primary Examiner* — An H Do

(74) *Attorney, Agent, or Firm* — Fish & Richardson P.C.

(57) ABSTRACT

A drop ejection device including a flow path in which fluid is pressurized to eject drops from a nozzle opening on a surface, a piezoelectric actuator for pressurizing said fluid, and one or more waste fluid control apertures on the surface proximate the nozzle opening, the one or more apertures being isolated from the flow path.

20 Claims, 7 Drawing Sheets

FOREIGN PATENT DOCUMENTS

| | | |
|---|---|---|
| JP | S57-63266 | 4/1982 |
| JP | S57-188372 | 11/1982 |
| JP | S61-39303 | 9/1987 |
| JP | H02-258353 | 10/1990 |
| JP | H08-230185 | 9/1996 |
| JP | 2001-260361 | 9/2001 |
| JP | 2002-187295 | 7/2002 |
| JP | 2002-292895 | 10/2002 |
| JP | 2003-237094 | 8/2008 |

OTHER PUBLICATIONS

International Search Report and Written Opinion dated Jan. 6, 2006 from corresponding PCT Application No. PCT/US2004/043946.

International Preliminary Report on Patentability dated Jul. 13, 2006.

Office action received in co-pending Japanese application No. 2006-547572 dated Jun. 21, 2011, 12 pages.

Authorized officer S.B. Kim, Korean Intellectual Property Office, Notice to File a Response in Application No. 10-2006-7015519 dated Aug. 1, 2011, 6 pages.

English translation of Authorized officer Yu Juanjuan, Chinese Patent Office, Text of First Office Action in Application No. 200480040663.0 mailed May 28, 2008, 2 pages.

Partial Search Report mailed Dec. 20, 2011 in EP application No. 11183973.4 (5 pgs).

Office Action from corresponding Korean Application No. 10-2006-7015519, mailed Mar. 22, 2012, 7 pages.

Extended European Search Report from corresponding European Application No. 11183973.4, mailed Apr. 11, 2012, 9 pages.

Office Action received in co-pending Japanese Application No. 2006-547572 dated Jun. 25, 2012, 9 pages including English translation.

* cited by examiner

DROP EJECTION ASSEMBLY

CROSS-REFERENCE TO RELATED APPLICATION

This application is a divisional and claims priority from U.S. Ser. Nos. 11/805,904, filed May 25, 2007, now U.S. Pat. No. 7,578,573, and 10/749,829, filed Dec. 30, 2003, now U.S. Pat. No. 7,237,875, both of which are incorporated herein by reference in their entirety.

TECHNICAL FIELD

This invention relates to ejecting drops.

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100-300 nozzles/inch, have a resolution of 100 to 3000 dpi or more, and provide drops with a volume of about 1 to 120 picoliters (pL) or less. Drop ejection frequency is typically 10 kHz or more.

Hoisington et al. U.S. Pat. No. 5,265,315, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink jet print assemblies are also described in Fishbeck et al. U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In an aspect, the invention features a drop ejection device that includes a flow path in which fluid is pressured to eject drops from a nozzle opening, a piezoelectric actuator for pressurizing the fluid, and one or more waste fluid control apertures proximate the nozzle opening. The aperture is in communication with a vacuum source.

In another aspect, the invention features an ejecting fluid by providing a fluid drop ejection apparatus including a nozzle opening and at least one waste fluid control aperture, the waste fluid control aperture in communication with a vacuum, and ejection of fluid at a frequency of about 10 KHZ or greater, and drawing waste fluid through said apparatus in an amount of about 5% or less of the fluid ejected at an operating vacuum of about 5 inwg or less. Vacuum pressures herein are in inches of water gauge, inwg.

In an aspect, the invention features an ejecting fluid providing a fluid drop ejection apparatus including a nozzle opening and at least one waste fluid control aperture, and without ejecting a drop, directing a bolus of said fluid through the nozzle opening in a manner to communicate with the aperture.

In an aspect, the invention features a drop ejection device with a flow path in which fluid is pressurized to eject drops from a nozzle opening, a piezoelectric actuator, and one or more fluid control apertures. The fluid control apertures are spaced from the nozzle opening by a distance of about 200% of the nozzle opening width or less, and each aperture has an aperture width of about 30% or less than the width of the nozzle opening.

Other aspects or embodiments may include combinations of the features in the aspects above and/or one or more of the following. The fluid control apertures are spaced from the nozzle opening by about 200% of the nozzle opening width or less. The fluid control apertures are spaced from the nozzle opening by about 200% to about 1000% of the nozzle opening width or less. The control apertures are in communication with the flow path in which fluid is pressurized. Each control aperture has a fluid resistance of about 25 times or more than the fluidic resistance of the nozzle opening. The average total flow through the apertures is about 10% or less than the average flow through the nozzle opening. Each aperture has a width of about 30% or less than the width of the nozzle opening. The width of the nozzle opening is about 200 microns or less. Each control aperture has a diameter of about 10 microns or less. A nonwetting coating is applied proximate the nozzle opening. The flow path, nozzle opening, and control aperture are defined in common body. The body is a silicon material. The control apertures are isolated from the flow path. The control apertures include a wicking material. The control apertures communicate with a waste container. The drop ejector includes at least three apertures. The method includes drawing about 2% of fluid ejected at about 2 inches of water or less. The control aperture and the nozzle opening are in communication with a common fluid supply and the fluid supply and the vacuum are communicated through the fluid supply. The control aperture is about 30% or less the diameter of the nozzle opening. The method includes periodically directing a bolus of fluid to maintain fluid in the aperture.

Embodiments may include one or more of the following advantages. Printing errors can be reduced by controlling waste ink that collects adjacent ejection nozzles, where it could interfere with ink ejection, or become disposed on the substrate and obscure an image. The waste ink can be controlled by directing and containing it in controlled locations by using vacuum, capillary forces, gravity and/or surface tension effects. The waste ink can be recycled to an ink supply, or directed to a waste container off the nozzle plate surface. The waste control aperture features can be formed accurately on a nozzle plate by, e.g., etching a semiconductor material such as a silicon material.

The details of one or more embodiments of the invention are set forth in the accompanying drawings and the description below. Other features, objects, and advantages of the invention will be apparent from the description and drawings, and from the claims. All publications and patent documents referenced herein are incorporated by reference in their entirety.

Still further aspects, features, and advantages follow. For example, particular aspects include aperture dimensions, characteristics, and operating conditions as described below.

DETAILED DESCRIPTION

Figure 1:
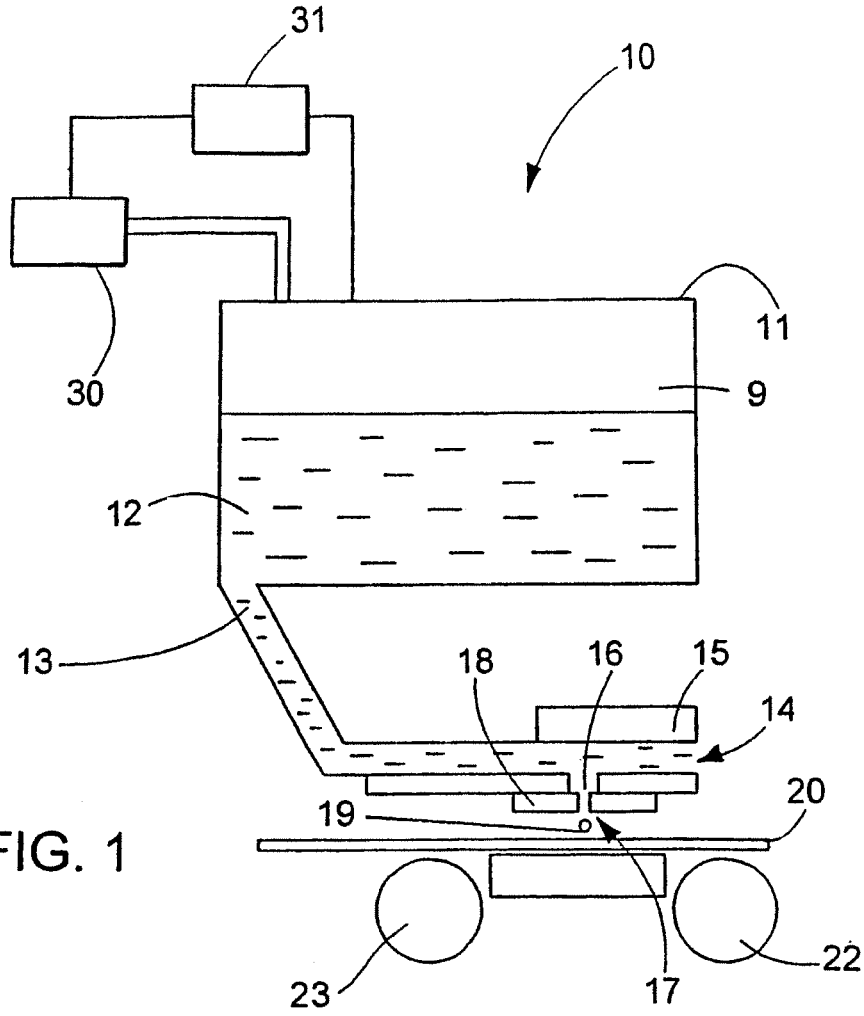
FIG. 1 is a schematic of a drop ejection assembly.

Referring to FIG. 1, an ink jet apparatus 10 includes a reservoir 11 containing a supply of ink 12 and a passage 13 leading from the reservoir 11 to a pressure chamber 14. An actuator 15, e.g., a piezoelectric transducer covers the pressure chamber 14. The actuator is operable to force ink from the pressure chamber 14 through a passage 16 leading to a nozzle opening 17 in an nozzle plate 18, causing a drop of ink 19 to be ejected from the nozzle 17 toward a substrate 20. During operation, the ink jet apparatus 10 and the substrate 20 can be moved relative to one another. For example, the substrate can be a continuous web that is moved between rolls 22 and 23. By selective ejection of drops from an array of nozzles 17 in nozzle plate 18, a desired image is produced on substrate 20.

The inkjet apparatus also controls the operating pressure at the ink meniscus proximate the nozzle openings when the system is not ejecting drops. In the embodiment illustrated, pressure control is provided by a vacuum source 30 such as a mechanical pump that applies a vacuum to the headspace 9 over the ink 12 in the reservoir 11. The vacuum is communicated through the ink to the nozzle opening 17 to prevent ink from weeping through the nozzle opening by force of gravity. A controller 31, e.g. a computer controller, monitors the vacuum over the ink in the reservoir 11 and adjusts the source 30 to maintain a desired vacuum in the reservoir. In other embodiments, a vacuum source is provided by arranging the ink reservoir below the nozzle openings to create a vacuum proximate the nozzle openings. An ink level monitor (not shown) detects the level of ink, which falls as ink is consumed during a printing operation and thus increases the vacuum at the nozzles. A controller monitors the ink level and refills the reservoir from a bulk container when ink falls below a desired level to maintain vacuum within a desired operation range. In other embodiments, in which the reservoir is located far enough below the nozzles that the vacuum of the meniscus overcomes the capillary force in the nozzle, the ink can be pressurized to maintain a meniscus proximate the nozzle openings. Variations in meniscus can cause variations in drop velocity and can lead to air injection or weeping. In embodiments, the operating vacuum maintained at the meniscus is about 0.5 to about 10 inwg, e.g., about 2 to about 6 inwg.

Figure 2:
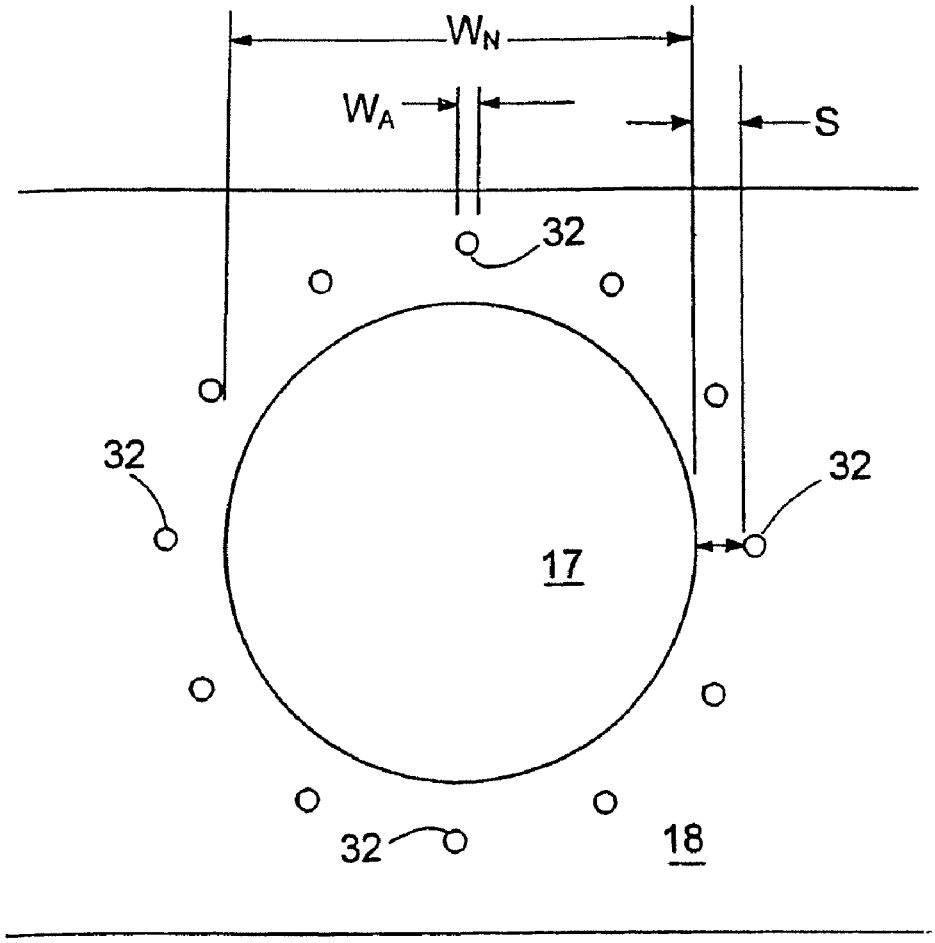
FIG. 2 is a top view of a portion of a nozzle plate.
Figure 3:
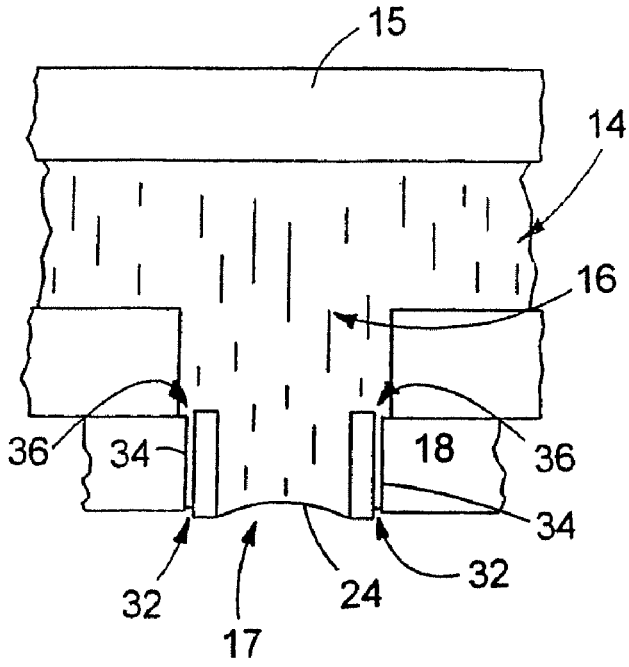
FIGS. 3-3C are cross-sectional views of a nozzle illustrating drop ejection.

Referring to FIGS. 2 and 3, nozzle 17, having a nozzle width, $W_N$, is surrounded by waste ink control apertures 32, having an aperture width, $W_A$. The apertures generally surround the nozzle and are spaced a distance, S, from the periphery of the nozzle. Referring particularly to FIG. 3, the apertures communicate through a lumen 34 and an opening 36 with an ink passage upstream of the nozzle opening. During ink jetting, ink may collect on the nozzle plate. Over time, ink can form puddles which cause printing errors. For example, puddles near the edge of a nozzle opening can effect the trajectory, velocity or volume of the ejected drops. Also, a puddle could become large enough so that it drips onto printing substrate causing an extraneous mark. The puddle could also protrude far enough off the nozzle plate surface that the printing substrate comes into contact with it, causing a smear on the printing substrate. The apertures 32 provide a region in which waste ink can collect to avoid forming excessive puddles. Ink can be drawn into the apertures 32 by capillary force and/or by vacuum produced by the piezoelectric actuator 15 and/or the vacuum source 30.

Figure 3A:
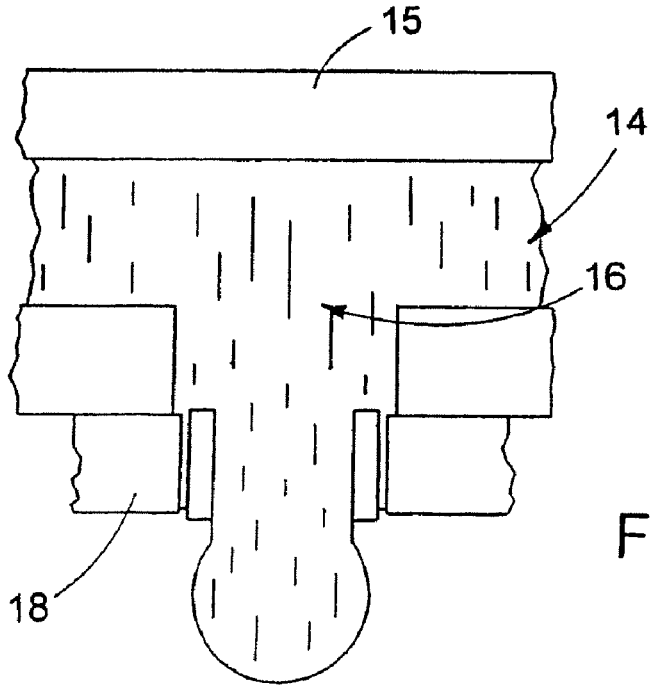
Figure 3B:
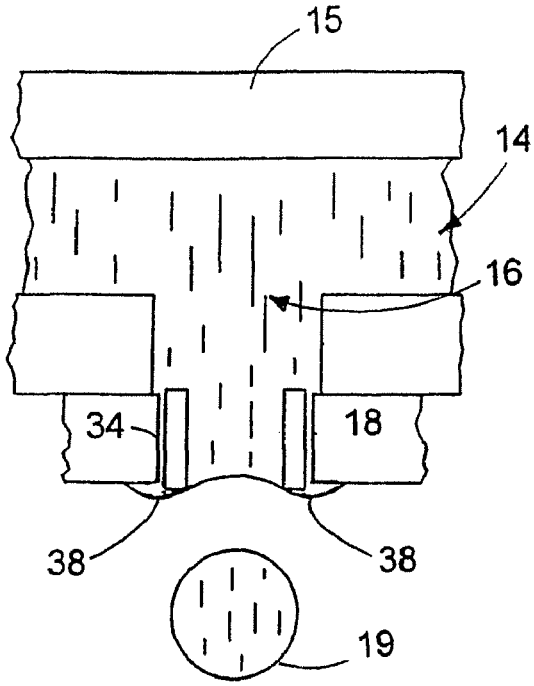
Figure 3C:
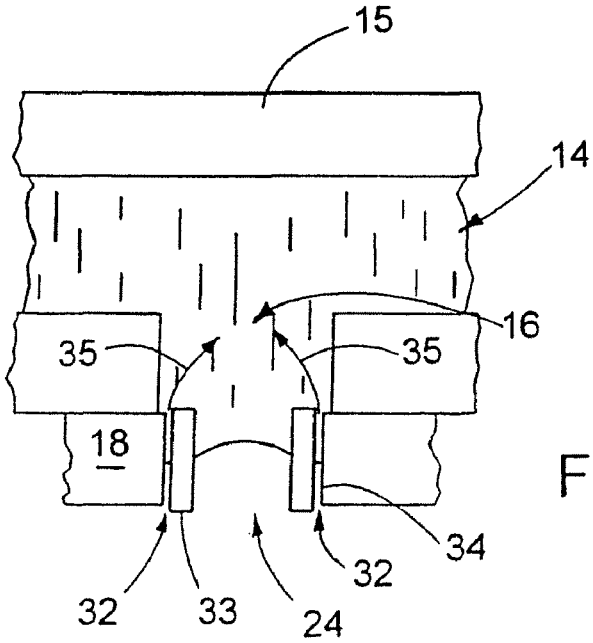

Referring to FIGS. 3-3C, the operation of the ink control apertures during drop ejection is illustrated. Referring particularly to FIG. 3, the nozzle 17 is illustrated in a non-jetting condition in which an ink meniscus 24 forms in nozzle 17. Referring particularly to FIGS. 3A and 3B, on actuation, ink is directed out of the nozzle opening 17 and a drop 19 is formed and ejected. Referring particularly to FIG. 3A, ink may also protrude from apertures 32, but it is not ejected from the apertures. Referring particularly to FIG. 3B, during the ejection process, waste ink 38 may be deposited onto nozzle plate 18. For example, waste ink can be disposed on the nozzle plate as the drop separates from the ink or backsplashes in flight or satellites drops can be directed back to the nozzle plate. Referring to FIG. 3C, after drop ejection or in preparation for ejection of the next drop, the meniscus 24 is withdrawn by a vacuum. The vacuum may be created the vacuum source 30 and/or by the piezoelectric actuator as it is actuated from a pressurizing condition, in which the actuator pressurizes ink 12 in chamber 14 to eject a drop, to a neutral or negative condition in preparation for the next drop ejection. The vacuum on nozzle 17 is also communicated to ink control openings 32 so that waste ink is drawn into the openings 32 and through lumens 34 in a direction indicated by arrows 35. As a result, waste ink does not pool excessively on the nozzle plate. In embodiments, the nozzle plate, particularly the region 33 between the nozzle opening and the aperture includes a nonwetting coating, e.g. a polymer such as a fluoropolymer (e.g. TEFLON) to prevent forming of puddles of ink stably in this region and to encourage waste ink flow into the aperture. The vacuum can also be produced by controlling the vacuum over the ink reservoir 11. A relatively wettable nozzle plate surface can be provided between the nozzle and the apertures and a nonwetting coating can terminate outside the circle of apertures to discourage ink flow beyond the apertures.

The size, number, spacing and pattern of the apertures are selected to prevent excessive waste ink pooling. For example, the size and number of apertures can be selected to prevent ejection of ink from the apertures while drawing a desired amount of waste ink without requiring large additional jetting forces for drop ejection. In embodiments, the apertures have a flow resistance sufficiently greater than the nozzle opening to prevent ink ejection from the apertures during drop ejection. In embodiments, the resistance of each aperture is about 25 times or more, e.g. 100 times or 200 times or more than the resistance of the nozzle. The total resistance of all the actuators is selected to withdraw a desired volume of waste ink without needing to significantly increase actuator displacement. The increase in actuator deflection can be estimated by comparing the average flow through the apertures with the nozzle flow. In embodiments, the average flow through the apertures is about 10% or less, e.g. 5% or 2% or less of the flow through the nozzle. In embodiments, the apertures are arranged to draw, 5%, 1%, 0.5%, 0.1% or less of the ink jetted.

For example, the flow resistance of a round cross sectioned channel is:

$$R_C = \frac{8\mu}{\pi}\frac{l_c}{r_C^4}$$

Where $l_c$ is the length of the channel, $r_C$ is the radius, $\mu$ is the fluid viscosity and $R_c$ is the resistance. The average flow through a channel is obtained by dividing the average pressure by this resistance. A system including twelve 3 micron apertures, each of which corresponds to 20% of the nozzle width, would have the following features. Because fluidic resistance varies inversely with the fourth power of diameter, apertures that have 20% of the nozzle diameter have 625 times the resistance. Twelve apertures surrounding the nozzle have a total resistance that is 52 times the resistance of the nozzle. The average flow through the apertures will be about 1/52, or 2% of the flow through the nozzle. For a piezoelectric actuator, actuation voltage, which causes the actuator displacement, increases by about 2%. Twelve 3 micron radius apertures that have a 30 micron long lumen can draw 636 pL of a 10 cps ink with a 2 inch water vacuum created at the ink reservoir. This accommodates jetting 10 pL drops at 63.6 kHz, capturing 0.1% of the ink. The vacuum at the apertures can increase substantially due to the actuator displacement during the fill stage of jetting in which the vacuum is created by the actuator as well as the vacuum in the reservoir.

In embodiments, the apertures are provided in a pattern that surrounds the nozzle opening. The apertures are spaced a distance, S, so that fluid does not collect adjacent the nozzle opening where it would influence drop ejection. In embodiments, the apertures are spaced closely adjacent the nozzle periphery. For example, in embodiments, spacing is about 200% or less, e.g., 50% or less, e.g. 20% or less of the nozzle width. In embodiments, apertures are positioned at greater spacing from the nozzle periphery, e.g., 200% to 1000% or more of the nozzle diameter. In embodiments, the apertures can be provided at various spacings, including closely spaced apertures and apertures of greater spacing. In embodiments, there are three or more apertures associated with each nozzle.

In particular embodiments, the apertures have a width of about 30% or less, e.g. 20% or less or 5% or less than the nozzle width. The vacuum on the apertures during fluid withdrawal is about 0.5 to 10 inwg or more. The nozzle width is about 200 micron or less, e.g. 10 to 50 micron. The ink or other jetting fluid has a viscosity of about 1 to 40 cps. Multiple nozzles are provided in a nozzle plate at a pitch of about 25 nozzles/inch or more, e.g. 100-300 nozzles/inch. The drop volume is about 1 to 70 pL.

Figure 4:
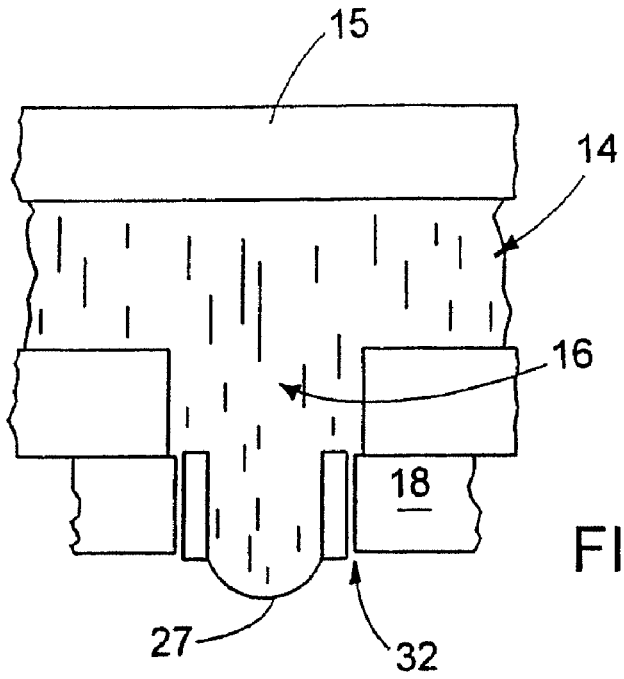
FIGS. 4-4A are cross-sectional views of a nozzle.
Figure 4A:
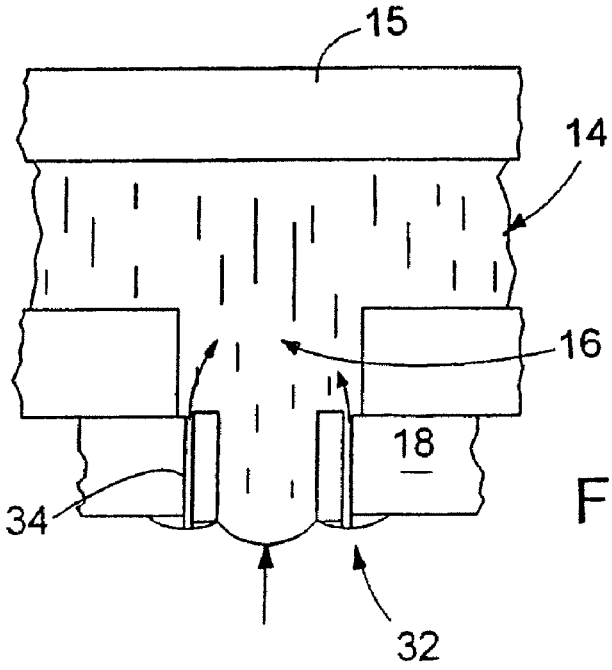

Referring to FIGS. 4-4A, a system can be operated to continuously direct ink into the control apertures 32 when not ejecting drops to avoid ink stagnation or ink drying in the apertures 32. Referring to FIG. 4, the actuator 15 is controlled to cause an ink bolus 27 to extend from the nozzle 17, but without sufficient energy to eject a drop. Referring to FIG. 4A, at a point of extension, the bolus 27 retracts into the nozzle and some of the ink spreads onto the surface of nozzle plate 18. The actuator 15 is then operated to create a vacuum on the nozzle 17 and control apertures 32. The ink on the nozzle plate is drawn into the control apertures 32. By periodically or continuously cycling the ink, a flow is induced to refresh the ink in the apertures 32.

Figure 5:
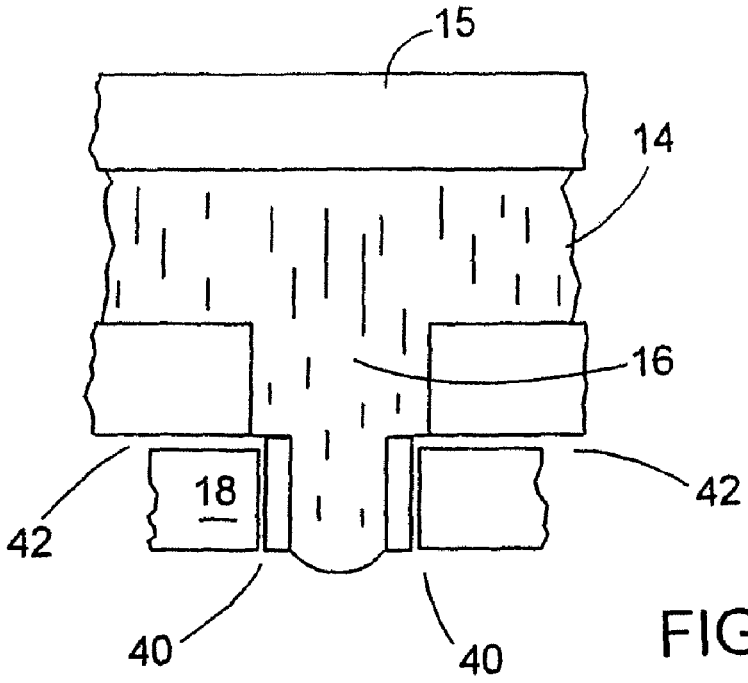
FIGS. 5-5A are cross-sectional views of a nozzle.
Figure 5A:
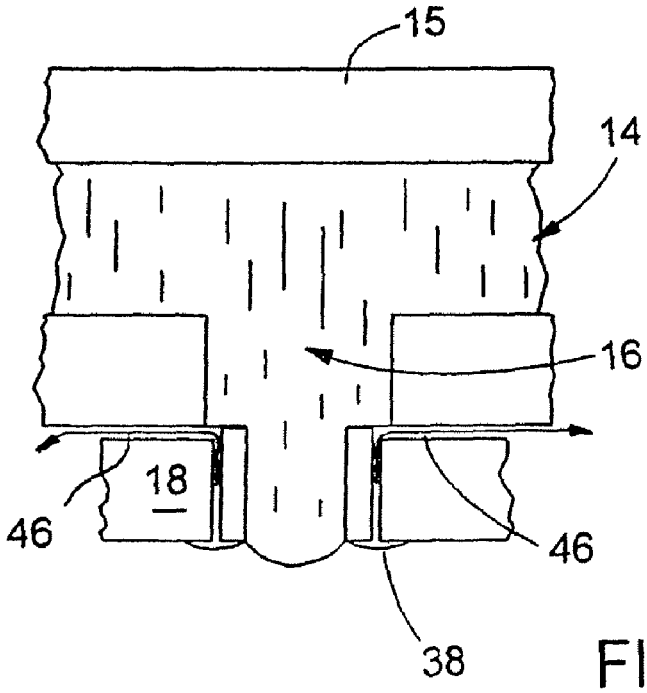

Referring to FIGS. 5-5A, control apertures 40 are in communication with a vacuum source that is isolated from the ink supply. Referring to FIG. 5, apertures 40 are in communication with a channel 42 that leads to a vacuum source such as a mechanical vacuum apparatus (not shown) that intermittently or continuously creates a vacuum. Referring to FIG. 5A, the vacuum draws waste ink from the nozzle plate (arrows 46). The ink drawn from the nozzle plate can be recycled to an ink supply or directed to a waste container. The apertures can have non-circular cross-sections. For example, the apertures can be oval-shaped with the major axis of the oval aligned with the radius of the nozzle opening.

Figure 6:
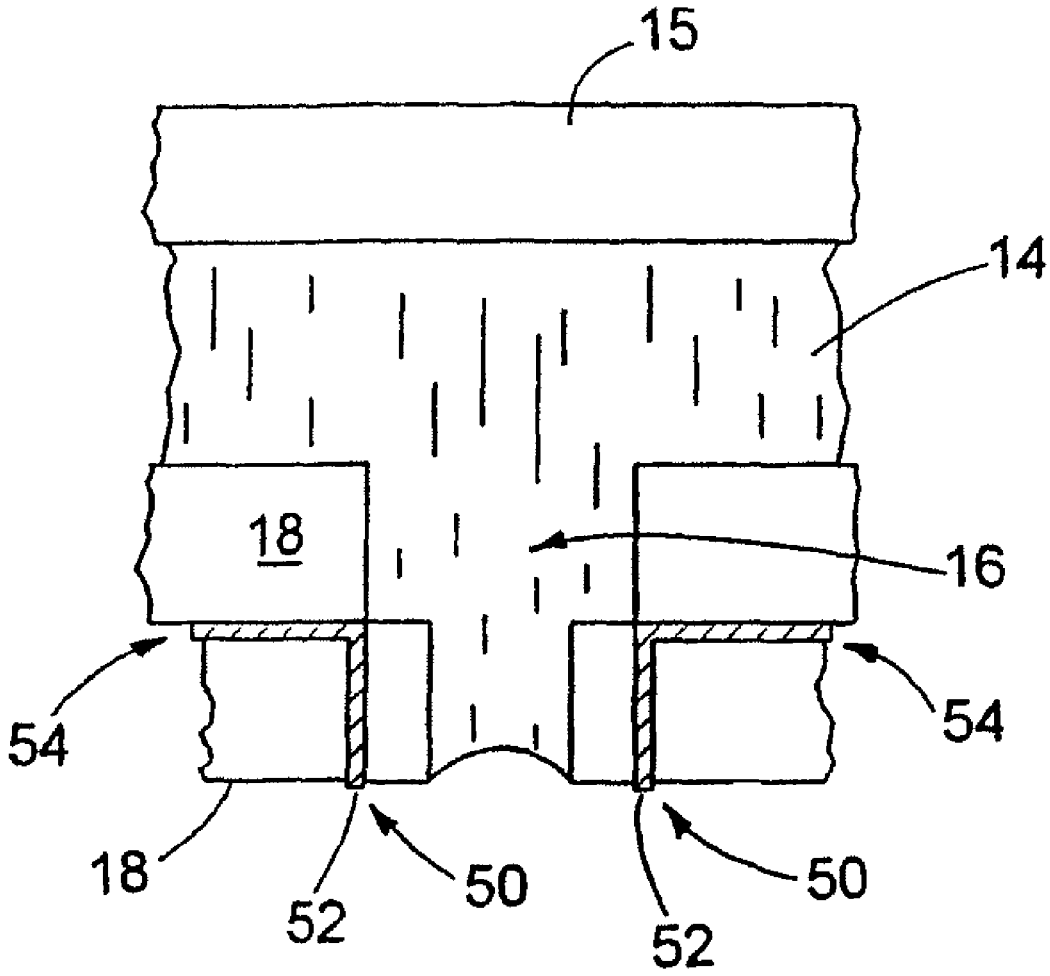
FIG. 6 is a cross-sectional view of a nozzle.

Referring to FIG. 6, control apertures 50 include an absorbent material 52 to encourage waste ink 38 flow by wicking or capillary action. The absorbent material 52 can be disposed in a channel 54 which leads to a bulk container of ink (not shown). The material 52 can protrude slightly above the surface of the nozzle plate 18. Suitable wicking materials include polymeric foams, e.g., a polyurethane foam, or other porous material. The polyurethane precursor material can be delivered to the apertures as a low viscosity fluid which polymerizes in-situ within the apertures, forming the wicking material.

The apertures and/or the nozzle opening in any of the above described embodiments can be formed by machining, laser ablation, or chemical or plasma etching. The apertures can also be formed by molding, e.g., injection molding. The apertures and nozzle opening can be formed in a common body or in separate bodies that are assembled. For example, the nozzle opening can be formed in a body that defines other components of an ink flow path, e.g. a pumping chamber and the aperture can be formed in a separate body which is assembled to the body defining the nozzle opening. In other embodiments, the apertures, nozzle opening, and pressure chamber are formed in a common body. The body can be a metal, carbon or an etchable material such as silicon material, e.g., silicon, silicon dioxide, a silicon nitride, or other etchable materials. Forming printhead components using etching techniques is further described in U.S. Ser. No. 10/189,947, filed Jul. 3, 2002, and U.S. Ser. No. 60/510,459, filed Oct. 10, 2003, the entire contents of both of which are hereby incorporated by reference.

The apertures can be used in combination with other waste fluid control features such as projections described in U.S. Ser. No. 10/749,816, filed Dec. 30, 2003, now issued as U.S. Pat. No. 7,121,646, wells as described in U.S. Ser. No. 10/749,622, filed Dec. 30, 2003, now issued as U.S. Pat. No. 7,168,788 and/or channels as described in U.S. Ser. No. 10/749,833, filed Dec. 30, 2003, the entire contents of all of the above applications is hereby incorporated by reference. For example, a series of channels can be included on the nozzle face proximate the apertures. The apertures can be provided within a well or channel or proximate projections. The cleaning structures can be combined with a manual or automatic washing and wiping system in which a cleaning fluid is applied to the nozzle plate and wiped clean. The cleaning structures can collect cleaning fluid and debris rather than jetted waste ink.

In embodiments, the drop ejection system can be utilized to eject fluids other than ink. For example, the deposited droplets may be a UV or other radiation curable material or other material, for example, chemical or biological fluids, capable of being delivered as drops. For example, the apparatus described could be part of a precision dispensing system. The actuator can be an electromechanical or thermal actuator. For example, the actuator can be electrostatic.

Other embodiments are within the scope of the following claims.

What is claimed is:

1. A drop ejection device, comprising:

a flow path including a pressure chamber, drops from a nozzle opening on a surface, a nozzle plate including a nozzle having a nozzle opening formed in a first surface of the nozzle plate, a piezoelectric actuator for pressurizing fluid in the pressure chamber to force the fluid through the nozzle to be jetted from the nozzle opening to form droplets to be deposited on a substrate, and one or more waste fluid control apertures that (a) are formed in the nozzle plate proximate the nozzle opening, (b) extend from the first surface through the nozzle plate to a second surface of the nozzle plate that is closer to the pressure chamber than the first surface, and (c) are isolated from the flow path.

2. The device of claim 1 including fluid control apertures which are spaced from the nozzle opening by about 200% of the nozzle opening width or less.

3. The device of claim 1 including fluid control apertures which are spaced from the nozzle opening by about 200% to about 1000% of the nozzle opening width or less.

4. The device of claim 1 wherein each control aperture has a fluid resistance of about 25 times or more than the fluidic resistance of the nozzle opening.

5. The device of claim 1 wherein the average total flow through the apertures is about 10% or less than the average flow through the nozzle opening.

6. The device of claim 1 wherein each aperture has a width of about 30% or less than the width of the nozzle opening.

7. The device of claim 1 wherein the width of the nozzle opening is about 200 microns or less.

8. The device of claim 1 wherein each control aperture has a diameter of about 10 microns or less.

9. The device of claim 1 including a nonwetting coating proximate the nozzle opening.

10. The device of claim 1 wherein the flow path, nozzle opening, and control aperture are defined in a common body.

11. The device of claim 10 wherein the body is a silicon material.

12. A drop ejection device, comprising:

a flow path in which fluid is pressurized to eject drops from a nozzle opening, a piezoelectric actuator, and one or more fluid control apertures, the fluid control apertures being spaced from the nozzle opening by a distance of about 200% of the nozzle opening width or less, and each aperture having an aperture width of about 30% or less than the width of the nozzle opening, wherein the apertures being isolated from the flow path.

13. The device of claim 12 includes at least three apertures.

14. The device of claim 12 including a nonwetting coating adjacent the nozzle opening.

15. The device of claim 12 wherein the flow path, nozzle opening, and control aperture are defined in a common body.

16. A method of ejecting fluid, comprising:

providing a fluid drop ejection apparatus including a flow path, a nozzle opening, and at least one waste fluid control aperture, the waste fluid control aperture being isolated from the flow path, ejecting fluid at a frequency of about 10 KHZ or greater, and drawing waste fluid through said aperture in an amount of about 5% or less of the fluid ejected at an operating vacuum of about 5 inches of water or less.

17. The method of claim 16 including at least three apertures.

18. The method of claim 16 comprising drawing about 2% of fluid ejected at about 2 inches of water or less.

19. The method of claim 16 wherein the control aperture is about 30% or less than the diameter of the nozzle opening.

20. The method of claim 16 wherein the diameter of the nozzle opening is about 200 microns or less.

* * * * *

UNITED STATES PATENT AND TRADEMARK OFFICE

CERTIFICATE OF CORRECTION

PATENT NO. : 8,287,093 B2
APPLICATION NO. : 12/510513
DATED : October 16, 2012
INVENTOR(S) : Paul A. Hoisington It is certified that error appears in the above-identified patent and that said Letters Patent is hereby corrected as shown below:

Col. 7, line 5, delete "drops from a nozzle opening on a surface,", therefor.

Signed and Sealed this
Fifteenth Day of January, 2013

David J. Kappos

David J. Kappos
*Director of the United States Patent and Trademark Office*